US005769233A

United States Patent [19]

Fredriks

[11] Patent Number: 5,769,233

[45] Date of Patent: Jun. 23, 1998

[54] ASSEMBLY OF AN OBJECT AND FOUR PACKAGING ELEMENTS, PACKAGING ELEMENT FOR USE IN THIS ASSEMBLY, AND PACKAGING METHOD

[75] Inventor: Jan Fredriks, Zwartsluis, Netherlands

[73] Assignee: Bestpak Holding B.V., Zwartsluis, Netherlands

[21] Appl. No.: 611,444

[22] Filed: Mar. 1, 1996

[30] Foreign Application Priority Data

Mar. 2, 1995 [NL] Netherlands ..... 9500416

[51] Int. Cl.[6] ..... B65D 81/107

[52] U.S. Cl. ..... 206/523; 206/305; 206/320; 206/586

[58] Field of Search ..... 206/305, 320, 206/521, 523, 586, 591, 594

[56] References Cited

U.S. PATENT DOCUMENTS

| | | | |
|---|---|---|---|
| 3,695,421 | 10/1972 | Wood . | |
| 4,063,702 | 12/1977 | Wilde et al. | 206/586 |
| 4,253,892 | 3/1981 | D'Angelo et al. | 206/523 |
| 4,792,046 | 12/1988 | Taylor | 206/523 |
| 5,267,651 | 12/1993 | Hughes | 206/586 |
| 5,299,685 | 4/1994 | Chin | 206/586 |

FOREIGN PATENT DOCUMENTS

| | | | |
|---|---|---|---|
| 592718 | 2/1960 | Canada | 206/586 |
| 0398790 | 11/1990 | European Pat. Off. . | |
| 2651747 | 3/1991 | France . | |
| 2827846 | 9/1979 | Germany | 206/586 |
| 9416373 | 12/1994 | Germany . | |
| 1458872 | 12/1976 | United Kingdom . | |

OTHER PUBLICATIONS

Netherlands Search Report for Netherlands Patent Application NL–9500416, Nov. 28, 1995 (3 pgs.).

*Primary Examiner*—Jimmy G. Foster
*Attorney, Agent, or Firm*—Webb Ziesenheim Bruening Logsdon Orkin & Hanson, P.C.

[57] ABSTRACT

The present invention comprises an assembly of a substantially block-shaped object and four packaging elements for placing over one or more edge parts formed by a short edge of the object, wherein the packaging elements are each manufactured from one piece of at least slightly flexible foamed plastic and each comprise:

a first engaging surface for engaging on a surface of the object which extends on one end of the edge substantially transversely thereof, and a second engaging surface for engaging on a second surface of the object which extends substantially parallel to the first surface on the other end of the edge.

9 Claims, 3 Drawing Sheets

ASSEMBLY OF AN OBJECT AND FOUR PACKAGING ELEMENTS, PACKAGING ELEMENT FOR USE IN THIS ASSEMBLY, AND PACKAGING METHOD

BACKGROUND OF THE INVENTION

Relatively vulnerable objects, for instance a housing with electronic components such as medical equipment, parts for photocopiers, video recorders and personal computers, must be provided in a cardboard box with buffer elements at the corners or edge parts thereof in order to absorb the forces occurring in a fall from a height of 70 cm.

Such packaging elements are usually manufactured from foamed plastic, such as polystyrene. Polystyrene has the drawback however that it is rather brittle and, partly for this reason, not re-usable. In addition, emission of environmentally unfriendly games can take place in the production of polystyrene.

Known from the American patent 3.695.421 is a packaging assembly of an object and four packaging elements which are pushed over a short edge of the substantially block-shaped object. The four packaging elements are each pushed over the corners with a simple manual operation, whereafter the packaging assembly is placed in a packing box. This known packaging assembly has the drawback that when a new electronic appliance comes onto the market, a considerable investment has to be made for the packaging elements since the mould shape must be adapted to the appliance. This will of course push up the costs of such a packaging element and thereby also the price of the new appliance. The known assembly further requires a large amount of foam material, of which a large part is not effective in absorbing impact load.

Further known from the French patent specification 2.651.747 is a packaging assembly of a substantially block-shaped object and two packaging elements which are slightly expandable. Because these packaging elements have to be arranged over short as well as long edges of the object, the operations required therefor make this packaging assembly unusable from a practical viewpoint in the existing process of rapid packaging of such objects.

SUMMARY OF THE INVENTION

The present invention provides an assembly of a substantially block-shaped object and four packaging elements for placing over one or more edge parts formed by a short edge of the object, wherein the packaging elements are each manufactured from one piece of at least slightly flexible foamed plastic and each comprise:

- a first engaging surface for engaging on a surface of the object which extends on one end of the edge substantially transversely thereof, and
- a second engaging surface for engaging on a second surface of the object which extends substantially parallel to the first surface on the other end of the edge, characterized in that each of the four packaging elements is provided with an expandable structure which extends between the first engaging surface and the second engaging surface.

The present invention further provides a packaging element for use in an assembly according to the present invention, wherein the expandable structure is substantially meander-shaped.

The meander-shaped structure preferably comprises two or more U-shaped mutually connected parts.

The present invention also provides a method for packaging an object, wherein four packaging elements according to any of the claims 2–7 are placed successively over a short edge of the object, if necessary by slightly expanding each thereof and wherein the object is placed together with the packaging elements in a packing box.

The assembly, packaging element and the method according to the present invention enable the use, within certain limits, of the same packaging elements for objects of different dimensions. The present invention also facilitates collection and re-use of such packaging elements, since a sorting according to the size of the associated appliance can be dispensed with.

Preferably used as foamed plastic is polypropylene, which is at least slightly flexible and less brittle than polystyrene and thus well suitable for re-use. Because these packaging elements are re-usable, they can be used first of all by a manufacturer of empty housings for electronic equipment and subsequently by a manufacturer who fits the electronic components in such housings.

Further advantages, features and details of the present invention will be elucidated on the basis of the following description of a preferred embodiment thereof with reference to the annexed drawings, in which:

DESCRIPTION OF THE PREFERRED EMBODIMENT

Figure 1:
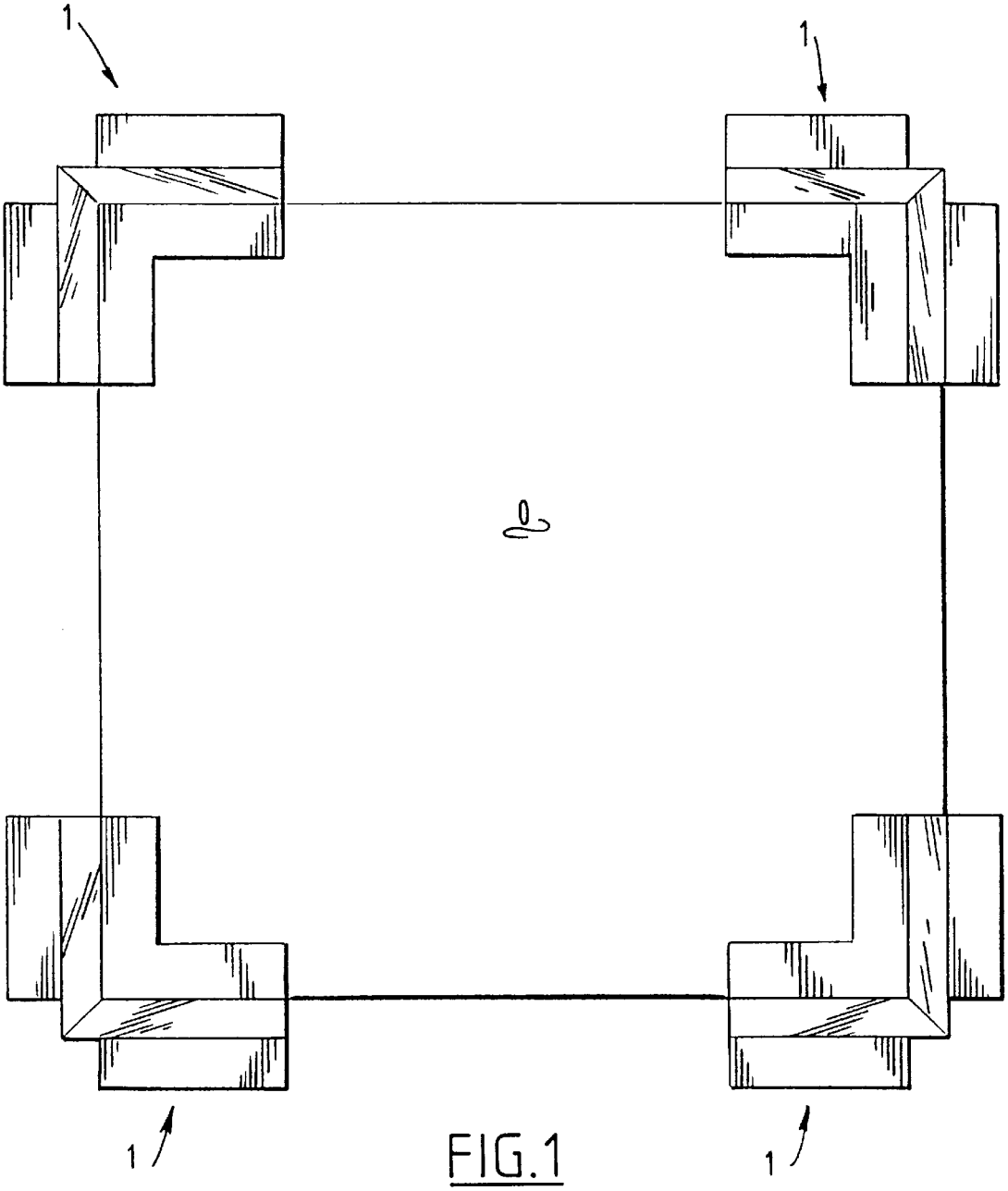
FIG. 1 shows by way of illustrating the method according to the present invention a top view of an object packaged by using four preferred embodiments of the packaging element according to the present invention.

A substantially block-shaped object 0 (FIG. 1) is provided at the corners, along the shortest sides or edges thereof, with four packaging elements 1 according to the present invention. Such an object 0 is pushed together with the four packaging elements 1 into a cardboard box in the usual manner, wherein the packaging elements 1 serve to absorb shocks or forces which occur if the cardboard box should happen to fall onto the ground from a determined height during transport.

Figure 2:
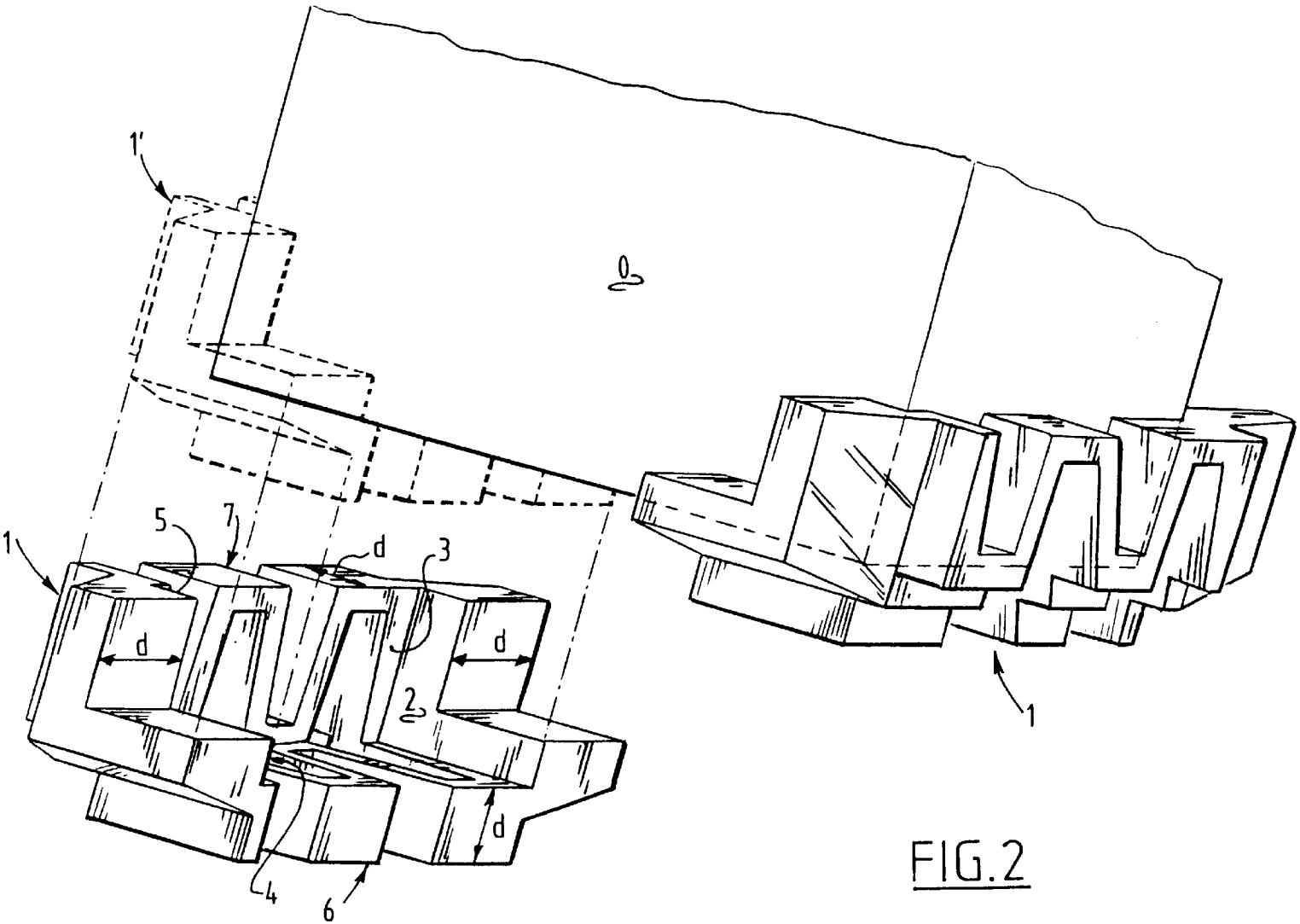
FIG. 2 shows a perspective view of a packaging element of FIG. 1.

As shown particularly in FIG. 2, a packaging element 1 comprises four engaging surfaces 2, 3, 4 and 5, wherein engaging surfaces 3 and 5 extend roughly in the same plane and engaging surfaces 2 and 4 are roughly parallel, are situated at a mutual distance and are roughly perpendicular to the surfaces 3 and 5. In the position designated with 1' the engaging surfaces 2–5 engage on substantially flat walls of the object 0, for instance a housing for a personal computer.

The packaging element 1, which is preferably manufactured from foamed polypropylene which is slightly flexible and suitable for re-use, exends in four directions from the surfaces 2–5 over a distance d, so that the forces occurring in an unforeseen fall can be absorbed by this foamed plastic mass. The distance d depends on the density of the foamed plastic and the weight of the object 0.

Extending between the engaging surfaces 2 and 5 are two meander-shaped parts 6 and 7 respectively which, since the plastic is slightly flexible, are stretched over a determined distance like a kind of concertina in order to adapt to the length of the side or edge of the object.

Figure 3:
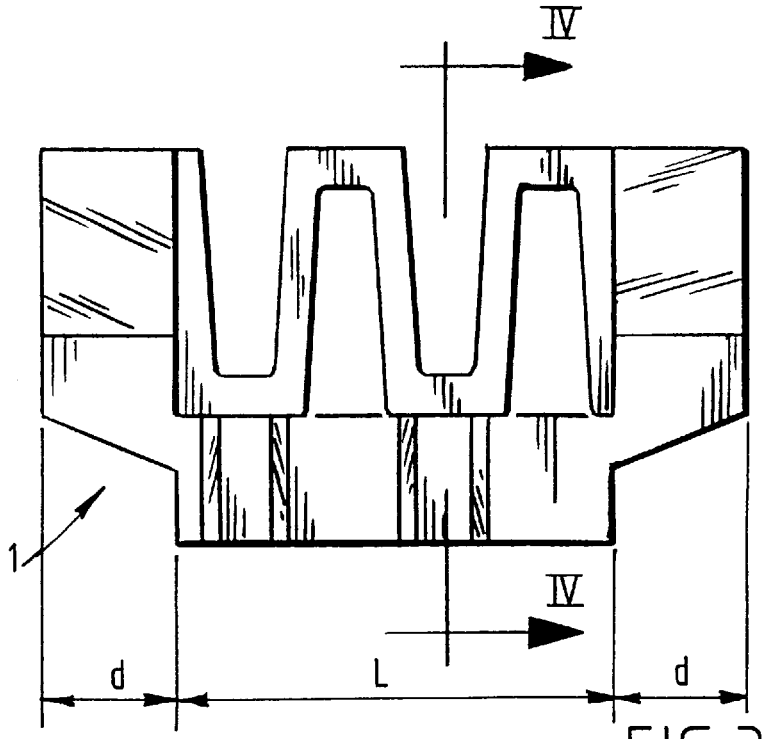
FIG. 3 shows a side view from the inside of the packaging element of FIG. 2.
Figure 4:
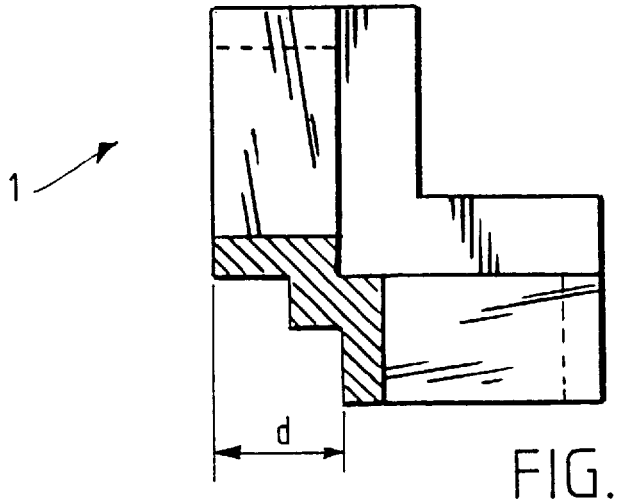
FIG. 4 is a sectional view along the line IV—IV of FIG. 3.

The length L in non-stretched situation of the packaging element 1 is shown In FIG. 3. In a first realized embodiment this dimension L amounts to 160 mm, wherein it can be stretched over a distance of 40–50 mm, and wherein the absorbing power of the foamed polypropylene with a density of 24 grams per litre remains preserved at such a stretch.

With this realized embodiment, wherein the distance d amounted to 50 mm, drop tests over a drop height of 70 cm were performed with a block-shaped object of 15 kg in weight. Acceleration transducers were placed on the object 0. The acceleration transducers placed on the bottom and side of the object recorded a maximum acceleration of respectively 37 g and 30 g over a period of respectively 24 and 27 milliseconds, wherein g is the gravitational acceleration. These measurements confirm the calculations made beforehand that the accelerations occurring with this embodiment amount to less than 40 g. The accelerations measured an the side, which are lower than the accelerations measured at the bottom, can be attributed to the absorbing power of the meander-shaped or zigzag-shaped parts of the packaging element which is increased by bending. In addition to the reduced use of material due to this meander shape as well as the possibility of stretching thereof, this absorbing bending is an added advantage of the packaging element according to the present invention.

It is the expectation that with the packaging element according to the present invention (block-shaped) objects with a shortest side of 100–200 mm can be packed at a weight of the object of 10–30 kg. Depending on the weight and the dimension, foamed polypropylene with a density of 18–35 grams per litre can be used. In accordance with set requirements the distance d (and the distance L) of the packaging element according to the present invention can of course also be varied. In addition to re-usable polypropylene, polyethylene can likewise be used with a slightly greater mass due to the smaller absorbing power, or another slightly flexible plastic which can be stretched and which has sufficient absorbing power, such as for instance possible forms of polystyrene.

The present invention is therefore not limited to the above described embodiment; the requested rights are determined in the first instance by the following claims.

I claim:

1. An assembly of a substantially block-shaped object and four packaging elements, each element configured to be placed over one edge part formed by the intersection of two side surfaces defining a corner and two opposing, substantially transverse surfaces abutting the side surfaces of the object, wherein each packaging element is manufactured from one piece of at least slightly flexible foamed plastic and each packaging element comprises:

a first engaging surface configured to engage the first transverse surface of the object, and a second engaging surface configured to engage the second transverse surface of the object with the second engaging surface extending substantially parallel to the first engaging surface, wherein each of the four packaging elements is provided with an expandable meander-shaped structure which extends between the first engaging surface and the second engaging surface and which wraps around the corner to enclose the two side surfaces of the edge part.

2. A packaging element configured to be placed over one edge part formed by the intersection of two side surfaces defining a corner and two opposing, substantially transverse surfaces abutting the side surfaces of an object, each packaging element formed from one piece of flexible foamed plastic and comprising:

a first engaging surface configured to engage the first transverse surface of the object, and a second engaging surface configured to engage the second transverse surface of the object, with the second engaging surface extending substantially parallel to the first engaging surface, wherein the packaging element includes an expandable structure extending between the first engaging surface and the second engaging surface, and wherein the expandable structure is substantially meander-shaped and which wraps around the corner to enclose the two side surfaces of the edge part.

3. A packaging element as claimed in claim 2, wherein the foamed plastic is polypropylene.

4. A packaging element as claimed in claim 3, wherein the foamed polypropylene has a density of about 18–35 grams per litre.

5. A packaging element as claimed in claim 4, wherein the density of the polypropylene is about 22–28 grams per litre.

6. A packaging element as claimed in claim 2, wherein the meander-shaped structure has a length of about 100–200 mm, which length can be enlarged by about 50 mm by stretching.

7. A packaging element as claimed in claim 6, wherein the length the meander-shaped structure is about 160 mm.

8. A packaging element as claimed in claim 2, wherein the meander-shaped structure comprises at least two U-shaped mutually connected parts.

9. A packaging element as claimed in claim 4, wherein the density of the polypropylene is about 24 grams per litre.

* * * * *